US005209650A

United States Patent [19]

Lemieux

[11] Patent Number: 5,209,650

[45] Date of Patent: May 11, 1993

[54] INTEGRAL MOTOR AND PUMP

[76] Inventor: Guy B. Lemieux, 14326 Greencrest Drive, Surrey, B.C., Canada, V4P 1M1

[21] Appl. No.: 874,449

[22] Filed: Apr. 27, 1992

Related U.S. Application Data

[63] Continuation-in-part of Ser. No. 662,057, Feb. 28, 1991, abandoned.

[51] Int. Cl.[5] ..... F04B 35/04

[52] U.S. Cl. ..... 417/356; 417/365; 417/423.5; 415/199.5; 384/115

[58] Field of Search ..... 417/356, 365, 423.5, 417/423.12; 384/115, 119; 415/199.5

[56] References Cited

U.S. PATENT DOCUMENTS 4,919,549 4/1990 Lawson et al. ..... 384/119

FOREIGN PATENT DOCUMENTS 0847690 8/1952 Fed. Rep. of Germany ..... 417/354

*Primary Examiner*—Richard A. Bertsch
*Assistant Examiner*—Charles G. Freay
*Attorney, Agent, or Firm*—Townsend and Townsend Khourie and Crew

[57] ABSTRACT

A pump integral with an electric motor has an integral rotor and impeller assembly that rotates within a stator casing and is supported on hydrostatic radial and thrust bearings. The pump avoids having to provide external seals or friction type bearings. The unit has a stator with windings therein contained within a pump casing which has an axial liquid entry and a liquid outlet. An integral rotor and impeller assembly is mounted for rotation on a fixed axial shaft within the stator. The integral rotor and impeller assembly is positioned axially relative to the stator casing by hydrostatic thrust bearings where the pressure for the thrust bearing fluid is generated by radial ducts located within the integral rotor and impeller assembly.

17 Claims, 5 Drawing Sheets

INTEGRAL MOTOR AND PUMP

CROSS REFERENCE TO RELATED APPLICATION

The present application is a continuation-in-part of co-pending application Ser. No. 07/662,057 filed on Feb. 28, 1991, now abandoned.

TECHNICAL FIELD

The present invention relates to a pump integral with an electric motor. More specifically, the present invention relates to an integral motor and pump having at least one stage, with a rotor and an impeller combined in a single rotating element. The rotating element is supported within the stator and pump casing on hydrostatic radial and hydrostatic thrust bearings.

BACKGROUND ART

The combination of a fluid pump and an electric motor into a single device has been the subject of patent literature for approximately the last sixty-five years. In spite of claims of reduced manufacturing costs, such a pump has yet to find popular application within the industrial world. The pumps disclosed in the literature are generally axial flow pumps or mixed flow pumps which appear to be restricted to high flow, low head applications. Multiple stage axial flow pumps are also known.

Other concerns with combined motor and pump units include the practical resolution of fluid seals and bearing application.

One example of a fluid flow device incorporating an integral motor and pump is disclosed by Richter in U.S. Pat. No. 3,276,382. In this patent, counter rotating impellers are provided which each form part of a tubular rotor that rotates inside a stator as shown in FIG. 3. The tubular rotor of the motor has anti-friction bearings to take into account both radial and thrust loads. An O-ring provides the seal between the tubular rotor and the casing.

DISCLOSURE OF INVENTION

I have discovered that an integral motor and pump system can be made which utilizes hydrostatic radial bearings and hydrostatic thrust bearings, thus avoiding the problems that occur with leaking mechanical seals and worn bearings that have plagued this design up until the present time. The rotor/impeller assembly is completely contained within the stator/pump casing, and external mechanical seals or stuffing boxes are not required.

Furthermore, in one embodiment the pump design of the present invention utilizes multiple stages of axial or mixed flow pump elements with adjacent elements rotating in opposite directions. The adjacent impellers are separated by fixed inter-stage diffusion vane assemblies. Seal liquid is provided to the impellers for hydrostatic radial bearings and for hydrostatic thrust bearings. In a preferred embodiment the seal liquid consists of clean water, in other embodiments pumped liquid or other liquids may be provided to the impeller bearings. The seal liquid is provided at a higher pressure, slightly higher or greater, than the inlet pressure of the product pumped through the assembly, thus seal liquid passes through a mechanical seal and enters the liquid passage of the impeller. No liquid product pumped through the assembly is forced into any areas which may allow entrained solid materials in the liquid product to accumulate.

In one embodiment illustrated and defined herein, the seal liquid is shown supplied from an external source. However, seal liquid may comprise the pumped liquid taken from an appropriate position in the liquid passage of the impeller or downstream of the impeller and circulated to the impeller bearings.

The present invention provides an integral motor and pump comprising a stator having windings therein, integral with a pump casing, the pump casing having an axial liquid entry, a rotor mounted for rotation on a fixed axial shaft within the stator, the rotor integral with impeller means for pumping liquid, passage means through the fixed axial shaft for supplying seal liquid, at least one liquid duct in the rotor extending radially from the fixed axial shaft for supplying seal liquid centrifugally when the rotor rotates within the stator, and hydrostatic thrust bearings supplied with the pressurized seal liquid to axially position the rotor relative to the stator.

In another embodiment the present invention provides a multiple stage integral motor and pump comprising a first stage stator integral with a pump casing having an axial liquid entry, a first stage rotor mounted for rotation within the first stage stator on a fixed axial shaft, the first stage rotor adapted to rotate in a first rotational direction, and having a first axial liquid passageway with impeller means therein, a second stage stator, integral with the pump casing and in line with the first stage stator, a second stage rotor in line with the first stage rotor, mounted for rotation within the second stage stator on a second fixed axial shaft, the second stage rotor adapted to rotate counter to the first rotational direction, and having a second axial liquid passageway with impeller means therein, an intermediate diffuser means fixed within the pump casing, in line between the first stage rotor and the second stage rotor, having an inter-stage axial liquid passageway therethrough, passage means through at least one fixed axial shaft for supplying seal liquid, at least one liquid duct in at least one rotor, extending radially from the at least one fixed axial shaft to pressurize seal liquid centrifugally when the rotor rotates within the stator, and hydrostatic thrust bearings supplied with the pressurized seal liquid to axially position the first stage rotor relative to the first stage stator, and the second stage rotor relative to the second stage stator.

BRIEF DESCRIPTION OF DRAWINGS

In drawings which illustrate embodiments of the present invention,

FIG. 5A is a detailed sectional view of the hydrostatic thrust bearing arrangement of the embodiment shown in FIG. 5.

MODES FOR CARRYING OUT THE INVENTION

The integral motor and pump of the present invention is a general purpose pump and may have a single stage or may be a multiple stage pump. The pump assembly may be made in modules that can be assembled together into multiple stages. The length of modules is variable. The multiple stages may rotate in the same direction or in alternate opposing directions. Furthermore, the speed of the integral rotor and impeller in the different stages may be varied, preferably having higher speeds for downstream stages. The pump may be an axial flow pump, a mixed flow pump having both axial and radial liquid movement, a radial flow pump, or any other suitable type of pump having an integral rotor and impeller.

Figure 1:
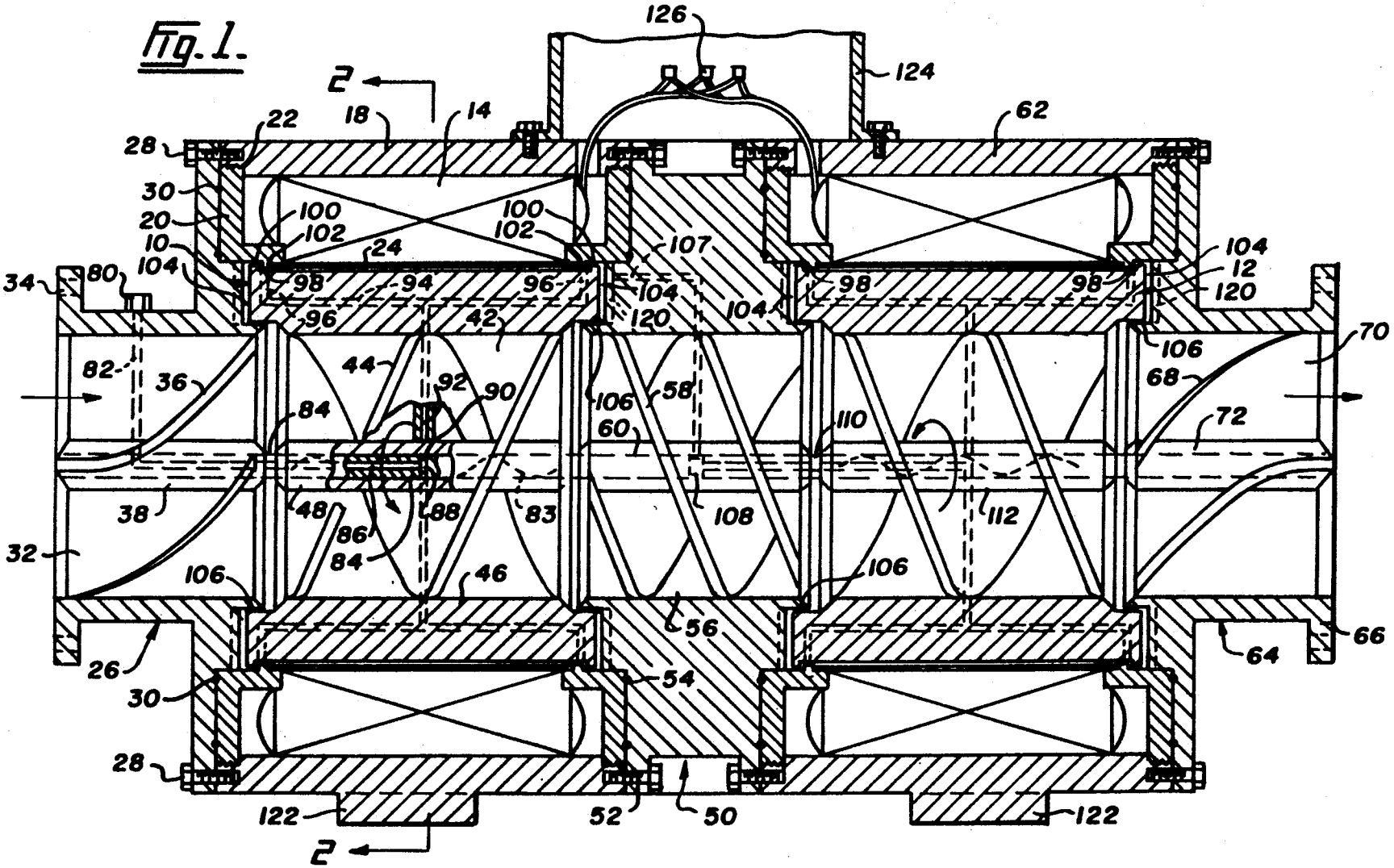
FIG. 1 is a longitudinal sectional view showing one embodiment of an integral motor and pump unit having two stages.
Figure 2:
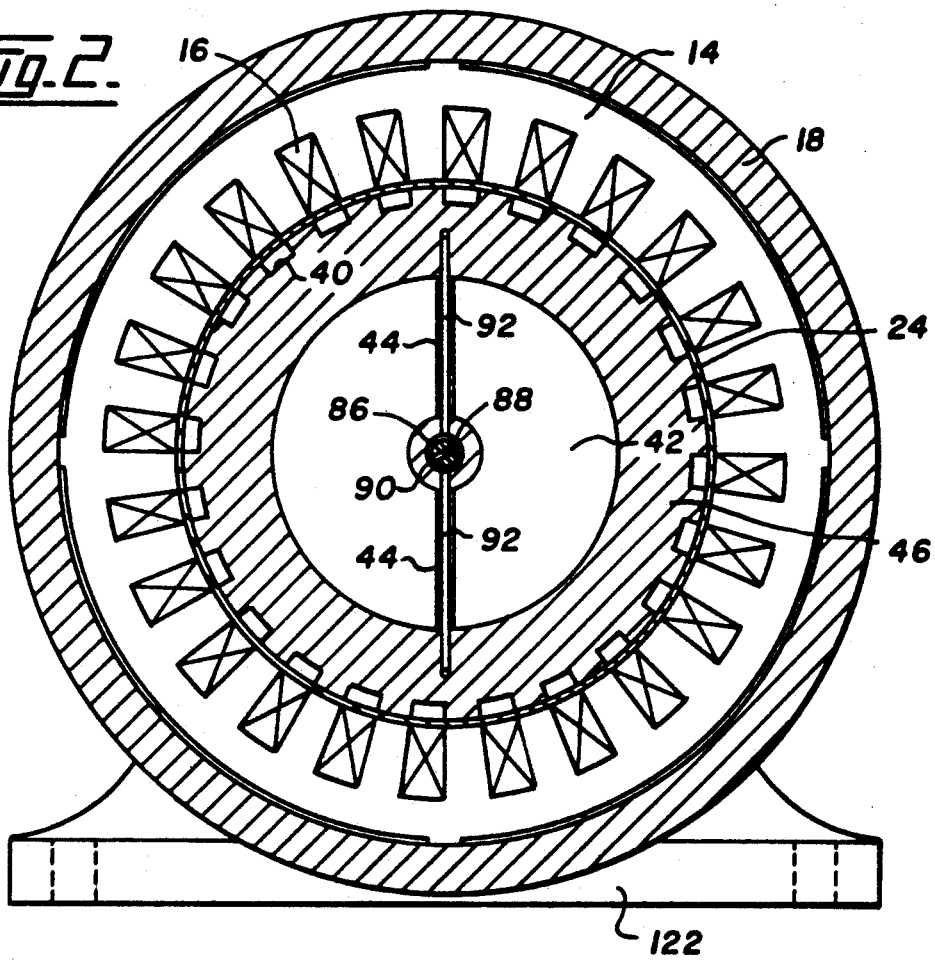
FIG. 2 is an end cross-sectional view taken at line 2—2 of FIG. 1.

FIG. 1 shows a two stage integral motor and pump. The pump is an axial flow pump having a first integral rotor and impeller assembly 10 that rotates in one direction and a second integral rotor and impeller assembly 12 that rotates in the other direction, thus the two rotor assemblies counter rotate. A first stage stator 14, having motor armature windings 16 as shown in FIG. 2, is contained within a first stage casing 18 having stator casing rings 20 at the input and the output which attach to the casing 18 by means of internal screw threads 22. An internal tubular member 24 formed of non-ferrous metal is placed within the stator 14 and is sealed at both ends to the casing rings 20, thus ensuring that liquid that passes through the pump cannot contact the stator windings. An inlet diffusion vane assembly 26 is bolted to the inlet end of the first stage casing 18 by flange bolts 28. O-ring seals 30 provide a seal between the inlet diffusion vane assembly 26 and the casing rings 20. These O-ring seals 30 do not act as mechanical seals as there is no movement between the inlet assembly 26 and the casing ring 20. An axial liquid passageway 32 passes through the inlet diffusion vane assembly 26. An exterior flange 34 is provided on the inlet assembly 26 for connection to an inlet pipe (not shown). Diffuser vanes 36 are provided in one embodiment in order to provide a counter pre-rotation to the incoming liquid to the pump. In other embodiments, the vanes 36 may be straight. The vanes 36 extend from the body of the inlet diffusion vane assembly 26 to a fixed axial hub 38.

The first stage rotor assembly 10 has at the periphery the electric motor rotor with a series of rotor bars 40 as shown in FIG. 2. The rotor bars are equi-spaced about the periphery of the rotor. A liquid passageway 42 passes through the first stage integral rotor and impeller assembly 10 and has a series of vanes 44 extending and fixed to the outer body 46 from a hub 48.

A stationary intermediate diffusion vane assembly 50 has flange bolts 52 to join to the outlet end of the first stage casing 18. O-ring seals 54 are provided between the intermediate assembly 50 and the casing ring 20. The intermediate assembly 50 has a liquid passageway 56 therethrough with diffuser vanes 58 from the body of the intermediate assembly 50 to a hub 60. The diffuser vanes 58 are spiral and are pitched in the opposite direction to the vanes 44 in the first stage integral rotor and impeller assembly 10. In other embodiments, the pitch of the intermediate diffuser vanes 58 may change from spiral at the inlet side of the intermediate assembly 50 to straight (axial) at the outlet side of the assembly 50.

The second stage is substantially the same as the first stage and the assemblies are made in modules that can be bolted together. The intermediate diffusion vane assembly 50 provides for the next stage to be bolted thereon. The inlet pitch of the vanes 50 in intermediate diffusion vane assemblies 50 is selected to match the flow vector (direction) of the pump product liquid.

The second stage integral rotor and impeller assembly 12 rotates in the opposite direction to the first stage integral rotor and impeller assembly 10. On the downstream end of the second stage casing 62 is an outlet diffuser vane assembly 64 with an exterior flange 66 for connection to the outlet pipe (not shown). Fixed diffuser vanes 68 are provided in a liquid passageway 70, the vanes 68 extending from the body of the outlet assembly 64 to an axial hub 72. The vanes 68 are pitched to diffuse the liquid from the second stage integral rotor and impeller assembly 12.

A seal liquid entrance 80 is provided on the inlet diffusion vane assembly 26. A seal liquid duct 82 passes through one of the inlet diffusion vanes 36 through the hub 38 and into a first shaft 84 that extends axially from the hub 38 of the inlet diffusion vane assembly 26 to the hub 60 of the intermediate diffusion vane assembly 50. This first stage shaft 84 is stationary and a key (not shown) or other locking arrangement is provided to prevent rotation of the shaft 84. A seal liquid duct 86 extends down the center of the first shaft 84 from the duct 82 to the mid-point of the first stage integral rotor and impeller assembly 10. The first shaft 84 has a radial hole 88 at the mid-point connecting to a circumferential groove 90 around the shaft 84. The impeller hub 48 rotates on the fixed shaft 84 and a space is provided between the shaft 84 and the interior surface of the impeller hub 48. Seal liquid from the seal liquid entrance 80 flows through to the circumferential groove 90 in the shaft 84 and then spreads on each side of the groove to provide a liquid film hydrostatic radial bearing for the first stage integral rotor and impeller assembly 10 to rotate on the first shaft 84. A spiral groove 83 on the shaft 84 ensures that liquid from the circumferential groove 90 flows along the surface of the shaft 84 covered by the hub 48. The hub 48 is preferably made of a suitable material less hard than the shaft 84, however the bearing relies on a liquid film having an appropriate thickness, rather than metal to metal contact.

Figure 1A:
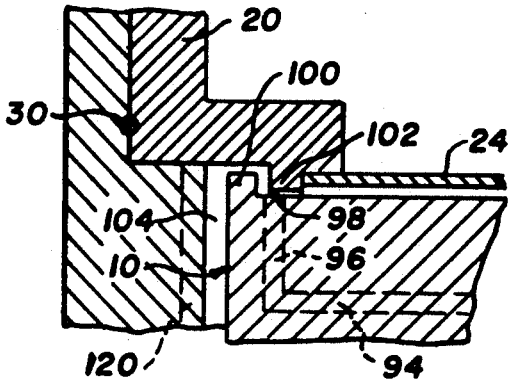
FIG. 1A is a detailed sectional view of the hydrostatic thrust bearing arrangement of the embodiment shown in FIG. 1.

The hub 48 has a radial duct 92 for seal liquid at the mid-point location which corresponds to the circumferential groove 90 in the first shaft 84. The duct 92 extends through the hub 48 and also through an impeller vane 44 into the outer body 46 where it joins to a further seal liquid duct 94 parallel to the first shaft 84. There are two radial ducts 92, preferably opposite each other, and two parallel ducts 94 in the outer body 46 which extend to both ends of the first stage integral rotor and impeller assembly 10. The parallel ducts 94 join at each end to radial ducts 96. These radial ducts 96 have openings 98 on the exterior surface of the first stage integral rotor and impeller assembly 10. FIG. 1 illustrates an internal rim 102 on each casing ring 20 that covers the openings 98 in the radial ducts 96 leaving an unrestricted portion of the opening 98 or gap towards each end of the first stage integral rotor and impeller assembly 10. This arrangement is seen more clearly in FIG. 1A. The ends of the first stage integral rotor and impeller assembly have exterior flanges 100 that overlap the internal rims 102 on the casing rings 20. Provision is made for the first stage integral rotor and impeller assembly 10 to move axially within the stator assembly, but the movement is restricted by the pressures in cavities 104. Seal liquid flows out of the portions of openings 98 that are unrestricted by rims 102 (gaps), over flanges 100, and into the cavities 104 at the entry and exit ends of the first stage integral rotor and impeller assembly 10. These cavities 104, in conjunction with the pressurized liquid contained there within, also serve as hydrostatic thrust bearings for the first stage integral rotor and impeller assembly 10.

Seal liquid is supplied under moderate pressure to the seal liquid entrance 80. The liquid flows through ducts 82, 86 and 88 to the circumferential groove 90 in the shaft 84. The pressure is sufficient for the seal liquid to provide a liquid film between the first shaft 84 and the hub 48 of the first stage integral rotor and impeller assembly 10 which acts as a radial bearing. As the seal liquid passes down the radial ducts 92 from the circumferential groove 90, the first stage integral rotor and impeller assembly 10 is rotating and centrifugal force pressurizes the seal liquid so that when it exits from the openings 98, after passing through ducts 94 and 96, the pressure of the seal liquid is considerably higher than when it entered the seal liquid entrance 80. Furthermore, the pressure of the seal liquid is higher than the pressure of the pump product liquid being pumped through the pump assembly. The rotor impellers 44 produce an axial thrust equal in magnitude and opposite in direction to the force exerted on the liquid being pumped through the pump assembly. The axial reaction of the first stage integral rotor and impeller assembly 10 is opposite to the direction of the pump product flow and thus the first stage integral rotor and impeller assembly 10 tends to move in this direction. When it moves, the openings 98 from which the seal liquid exits, move relative to the flanges 102 in the casing rings 20. This increases the gap at the opening 98 on the entry side and reduces the gap at the opening 98 on the exit side. Thus more seal liquid is applied at the end to which the first stage integral rotor and impeller assembly 10 has moved towards, namely the entry side. In addition to the imbalance of flows from the openings 92 caused by the axial movement of the integral rotor and impeller assembly 10, a further restriction of flow of seal water to the exit side cavity 104 is caused by the approach of flange 100 to rim 102. Axial movement of the integral rotor and impeller assembly 10 is therefore resisted by an opposite force produced by the imbalance of seal liquid flow and pressure within the cavities 104. Close tolerances are provided between the internal surfaces at each end of the integrated rotor and impeller assemblies 10 and external surfaces of the inlet assembly 26 and the intermediate assembly 50 to provide a mechanical seal 106 permitting seal liquid to form a film and flow through the seal 106 to the liquid passageway 42 in the integral rotor and impeller assembly 10. The mechanical seals 106 have a clearance which is sufficient to restrict the flow of sealing liquid from the cavities 104, and thereby maintain pressure in these cavities. The pressure in the cavities 104 is always higher than the pressure in the liquid passageway 42 so seal liquid also flows from the cavities 104 into the liquid passageway 42. Furthermore, when a cavity 104 becomes smaller due to the integral rotor and impeller assembly 10 moving in that direction, the length of the mechanical seal 106 increases thus the restriction in liquid flow is higher. This allows buildup of pressure in that particular cavity 104 to resist the axial thrust of the integral rotor and impeller assembly 10. In operation the integral rotor and impeller assembly 10 positions itself so that the difference in pressures in the opposite cavities 104 produce a net force upon the integral rotor and impeller assembly 10 which is equal in magnitude and opposite in direction to the force applied to the integral rotor and impeller assembly 10 by the pumped liquid.

Figure 1B:
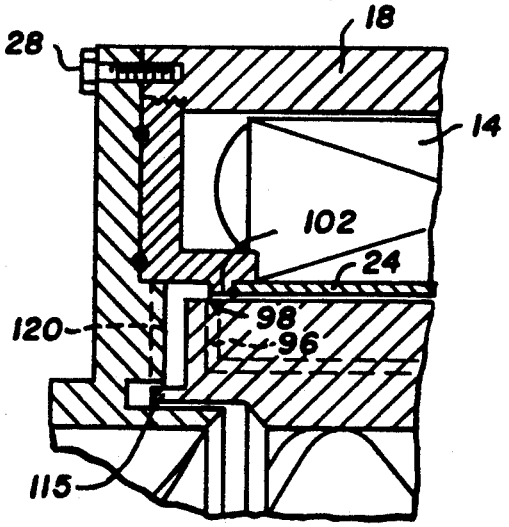
FIG. 1B is a detailed sectional view of the hydrostatic thrust bearing shown in FIG. 1A with the addition of a labyrinth seal.

In another embodiment a labyrinth seal 115 is shown in FIG. 1B to further restrict the flow of seal liquid through the mechanical seal 106. Such a liquid seal is required in certain conditions. Other types of mechanical seals may also be provided.

In the cavity 104, between the exit end of the integral rotor and impeller assembly 10 and the intermediate assembly 50, a further seal liquid duct 107 extends parallel to the shaft 84 and then turns at right angles to extend radially down through an intermediate diffuser vane 58 and the hub 60 to enter a space 108 in the center of the hub 60 between the first fixed shaft 84 and a second stage fixed shaft 110. From this point the arrangement of the seal liquid supply is the same as the first stage with seal liquid supplied to the radial bearing between the second fixed shaft 110 and the hub 112 of the second stage integral rotor and impeller assembly 12. The seal liquid flows through ducts and through openings 98 having exactly the same configuration as those of the first stage. Seal liquid in the second stage increases in pressure by the centrifugal action of the rotating integral rotor and impeller assembly 12, thus the cavities 104 on both ends of the second stage integral rotor and impeller assembly 12 have a higher pressure than those in the first stage. This ensures that the seal liquid pressures in the cavities 104 are higher than pressures occurring in the pump passageways thus seal liquid always passes through the mechanical seals 106 into the pump passageways.

The relative pressure between the seal liquid pressure in the cavities 104 and the product pressure in the pump inlet 32 is a function of the ratio of the outside diameter of the integral rotor and impeller assembly 10 to the diameter of the impeller passageway 42. The initial seal liquid pressure is always higher than the product inlet pressure; in some cases slightly higher, in other cases considerably higher, depending upon the particular process conditions. The seal pressure increase relative to the product pressure is a function of the ratios between these two diameters. Thus there is always a relatively high pressure in the seal water to provide thrust bearing forces in the cavities 104.

Figure 3:
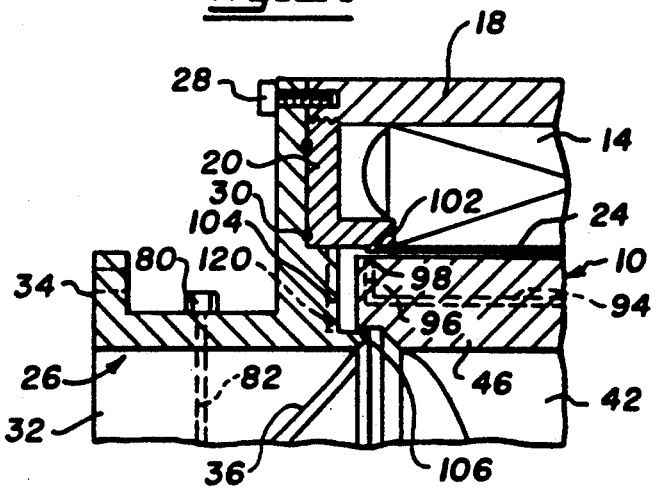
FIG. 3 is a detailed sectional view showing another embodiment of a hydrostatic thrust bearing arrangement and seal for a rotor.

A different hydrostatic thrust bearing arrangement is shown in FIG. 3 wherein the opening 98 from the duct 96 for the seal liquid at either end of the integral rotor and impeller assembly 10 is positioned opposite the face of the rim 102 on the casing rings 20. However, no flange is provided at each end of the integral rotor and impeller assembly 10. This arrangement still permits variation in flow of seal liquid from the opening 98 depending upon the position of the integral rotor and impeller assembly 10. The rim 102 as shown in FIG. 1 provides a restriction in the flow of seal liquid to the cavities 104. There is sufficient clearance between rim 102 and the outer body 46 of the rotor and impeller assembly 10 so that they do not contact each other, and the rim 102 assists in a build up of pressure in the cavities 104. Flange 100 is omitted in FIG. 3 but the integral rotor and impeller assembly is easier to assemble as the flange 100 does not have to be attached to the integral rotor and impeller assembly 10 after insertion into the stator 14. In other embodiments, the integral rotor and impeller assembly 10 may have a flange 100 at the exit end of the integral rotor and impeller assembly 10, and not at the entry end.

Figure 4:
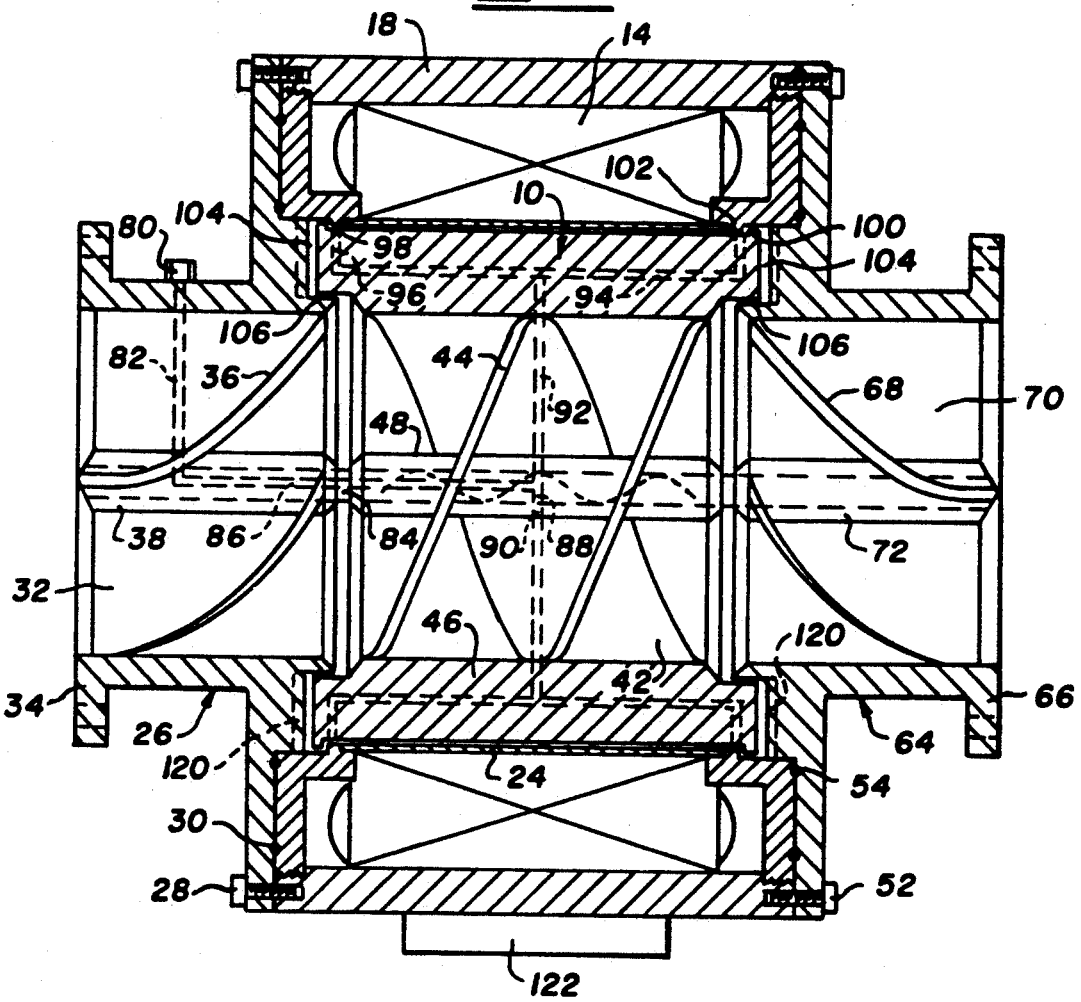
FIG. 4 is a longitudinal sectional view showing a further embodiment of an integral motor and pump unit having a single integral rotor and impeller assembly.

In FIG. 4 a single stage pump assembly is illustrated with a single stator 14, a single integrated rotor and impeller assembly 10 with an inlet diffusion vane assembly 26 and an outlet diffusion vane assembly 64. The radial bearing and thrust bearing arrangements utilizing seal water are the same as those shown in FIGS. 1 and 2. Thus, the complete unit is sealed and no stuffing boxes or anti-friction bearings are required. Furthermore the only mechanical seal is an internal seal, as there are no external mechanical seals. The thrust bearings are hydrostatic bearings dependent upon the supply of seal liquid to the cavities 104. The seal liquid has a restricted flow through the internal mechanical seals 106 on each end of the integral rotor and impeller assembly 10 to the liquid passageway 42.

The thrust bearing cavities 104 have flutes 120 as shown in dotted lines in both FIG. 1 and FIG. 4. The flutes 120 are on the stationary side of the cavities 104 and restrict rotation of water within the cavities. This feature facilitates application of uniform and maximum pressure throughout the cavities and to the mechanical seals 106.

Outer casings 18 and 62 are provided with standard motor mountings 122. Furthermore a protected connector box 124 is shown in FIG. 1 for electrical connections 126 to the stator windings 16.

The electric motor may be a conventional induction motor or a permanent magnet type motor. The motors may be variable speed or fixed speed, dependent upon the desired application. The pump may be an axial flow pump, a mixed flow pump, a radial flow pump or other suitable type of pump. The length of each pump module is dependent upon power requirements and other design features. In one embodiment multiple stage integral rotor and impeller assemblies have progressively increasing speeds in the same direction, and in another embodiment adjacent integral rotor and impeller assemblies are counter rotating to enhance the pressure addition of successive stages. The pump, being a general purpose pump, can be used for liquids, or liquid and solid mixtures, slurries or dispersions. In all cases the seal liquid is supplied at a somewhat higher pressure than the inlet pressure in the pump passageways.

Figure 5:
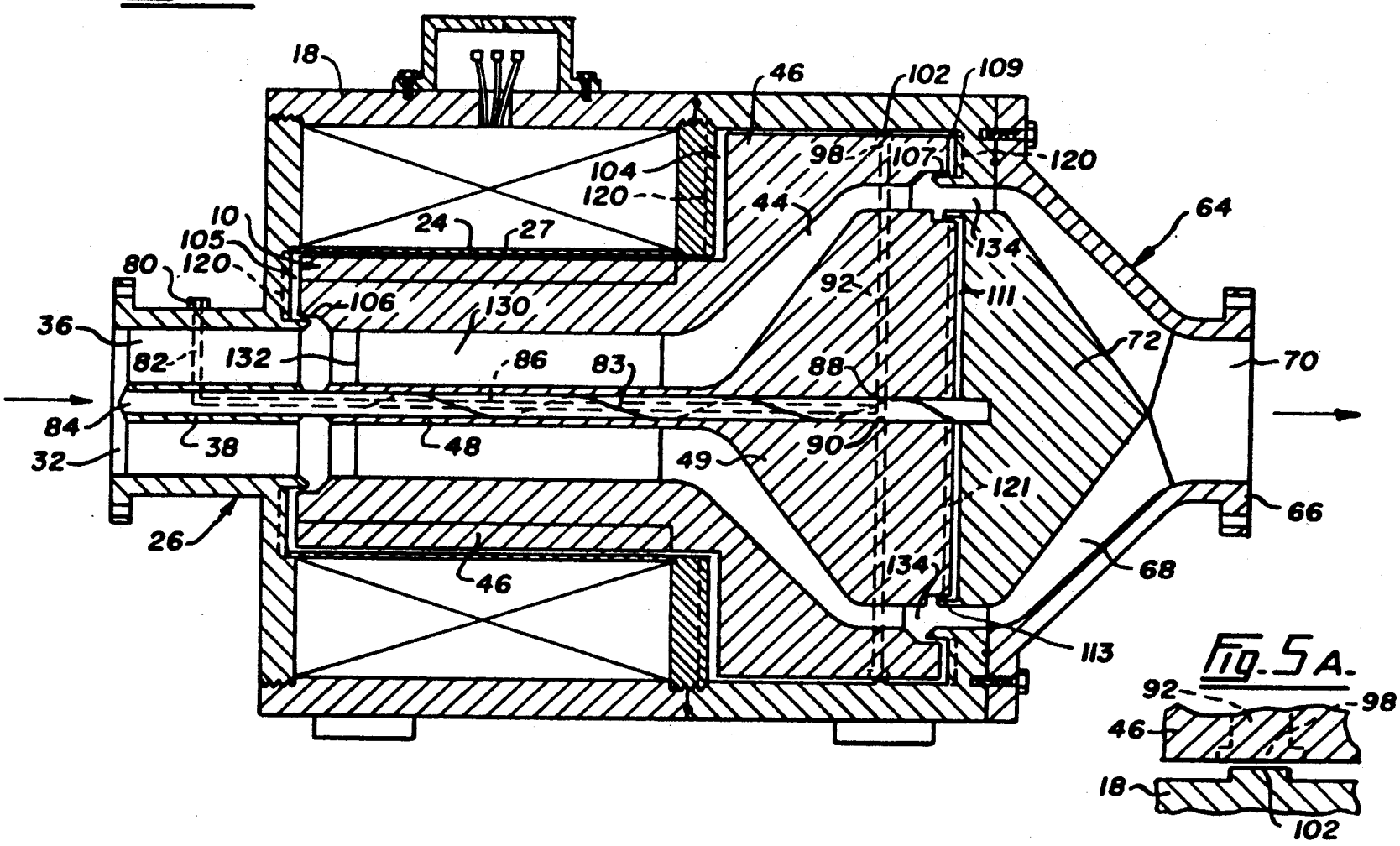
FIG. 5 is a longitudinal sectional view showing a still further embodiment of an integral motor and pump unit with a mixed flow pump.

FIG. 5 illustrates another embodiment of an integral motor and pump which has a mixed flow impeller. The integral rotor and impeller assembly 10 is positioned axially within the casing assembly 18 by hydrostatic thrust bearings. The pump product liquid enters passageway 32, flows through passageway 130 within the integral rotor and impeller outer body 46, through the pump and exits at the outlet passageway 70 in outlet assembly 64. The integral rotor and impeller assembly 10 has incoming vanes 132 which attach the rotor hub 48 to the outer body 46 at the inlet end of the assembly 10. The assembly 10 also has a mixed flow impeller consisting of a series of vanes 44 near the exit end of the assembly 10 which attach the impeller hub 49 to the outer body 46. The impeller hub 49 is integral with the rotor hub 48. Outlet diffusion vanes 68 connect outlet hub 72 to the body of outlet diffuser vane assembly 64.

A seal liquid entrance 80 is provided on the inlet diffusion vane assembly 26. A seal liquid duct 82 passes through one of the inlet diffusion vanes 36, through the hub 38 and into a seal liquid duct 86 in the shaft 84 that extends axially down the center of the shaft 84. The shaft 84 is stationary and a key (not shown) or other locking arrangement is provided to prevent rotation of the shaft 84. The shaft 84 has a radial hole 88 connecting to a circumferential groove 90 around the shaft 84. The impeller hub 49 rotates on the fixed shaft 84 and a space is provided between the shaft 84 and the interior surface of the impeller hub 49. Seal liquid from the seal liquid entrance 80 flows through to the circumferential groove 90 in the shaft 84 and then spreads on each side of the groove in a spiral groove 83 to provide a liquid film hydrostatic radial bearing for the integral rotor and impeller assembly 10 to rotate on the shaft 84. The spiral groove 83 ensures that liquid from the circumferential groove 90 flows along the surface of the shaft 84 covered by the rotor hub 48 and the impeller hub 49.

The impeller hub 49 has a radial duct 92 for seal liquid at the location which corresponds to the circumferential groove 90 in the shaft 84. The duct 92 extends through the impeller hub 49 and also through an impeller vane 44 into the integral rotor and impeller outer body 46 to the outer periphery of the integral rotor and impeller assembly 10. The radial duct 92 has an opening 98 on the exterior surface of the integral rotor and impeller body 46. A rim 102 extending inward from the pump casing 18 partially covers the opening 98, leaving unrestricted portions of the opening 98, or gaps at the inlet side and the outlet side of the rim 102. This embodiment is illustrated in FIG. 5A. Provision is made for the integral rotor and impeller assembly 10 to move axially within the casing assembly 18, but the movement is restricted by the pressures in the cavities 104, 105, 109 and 111. Seal liquid flows out of the portions of the openings 98 that are unrestricted by rims 102 (gaps) and into cavities 104 and 109. The seal liquid from cavity 104 flows through the clearance 27 between the integral rotor and impeller assembly 10 and the stator internal tubular member 24, to cavity 105, and then exits to the pump passageway 130 through internal seal 106. The seal liquid in cavity 109 exits to the pump passageway 134 through internal seal 107.

Thrust bearing cavities 104, 105 and 109 all have flutes 120 located on the stationary sides of the cavities. This feature facilitates application of uniform and maximum pressure to the mechanical seals 106 and 107.

Seal liquid enters the cavity 111 from the spiral groove 83 on shaft 84. Flutes 121 on the rotating side of cavity 111 induce a rotation of the fluid in cavity 111 thereby pressurizing this fluid. The pressure of the seal water at the outer radius of chamber 111 is equal to the total of the incoming seal water pressure and the pressure created by the centrifugal forces within chamber 111. The pressure at the outer radius of chamber 111 is therefore greater than the pressure of the main pump fluid and therefore the flow of seal liquid across internal mechanical seal 113 is from cavity 111 to the pump passageway 134.

The integral rotor and impeller assembly 10 is positioned within the casing assembly 18 by the same mechanism that is shown in FIG. 4. Movement of the integral rotor and impeller assembly 10 in one axial direction causes the gaps to be adjusted in such a way that more pressure is applied to the contracting chamber and less pressure is applied to the expanding chamber, thereby resisting that direction of axial movement. The integral rotor and impeller assembly 10 positions itself so that there is a balance of forces applied by the chambers 104, 105, 109 and 111, and the external forces on the integral rotor and impeller assembly 10.

Figure 6:
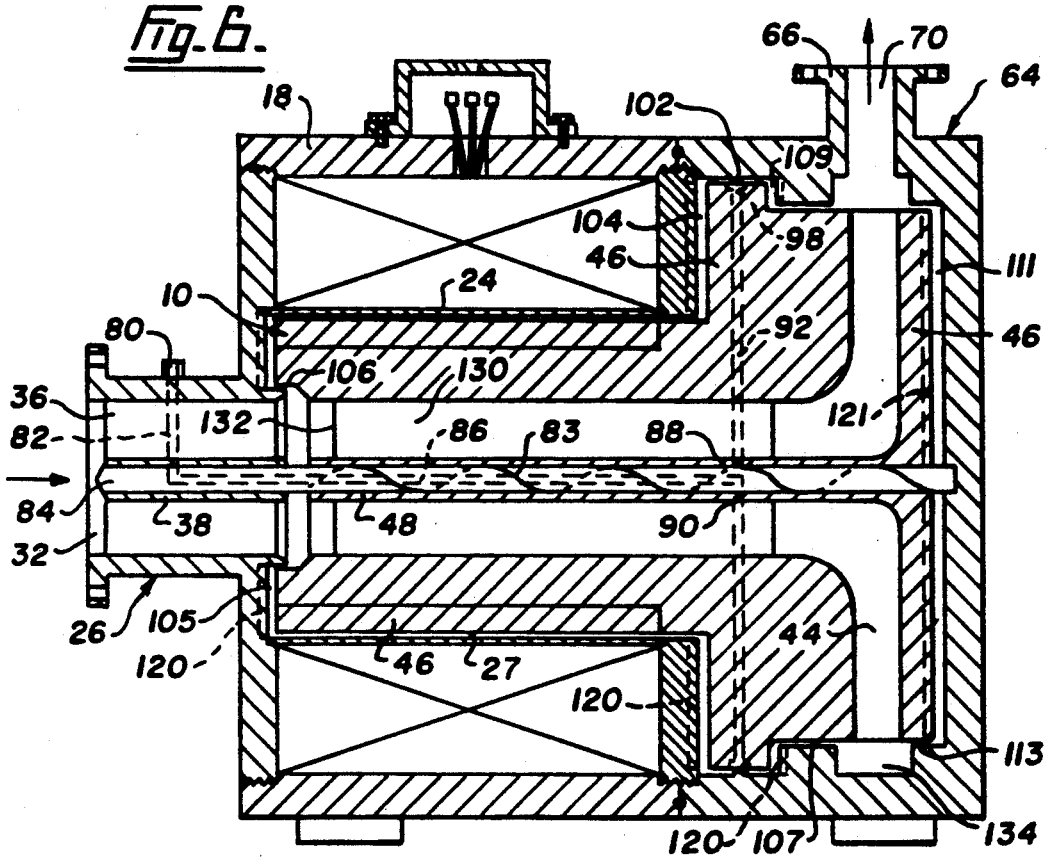
FIG. 6 is a longitudinal sectional view showing yet another embodiment of an integral motor and pump unit with a radial flow impeller and the axial liquid entry at the rotor end of the unit.

FIG. 6 illustrates another embodiment of the integral motor and pump which employs a radial flow impeller with vanes 44. The seal liquid pressurization system, hydrostatic radial bearing system, and hydrostatic thrust bearing system of this integral motor and pump are identical in principle to that of the integral motor and pump embodiments illustrated in FIGS. 1, 4 and 5. The discharge portion in this embodiment is a side discharge assembly 64 to accommodate the radial impeller.

Figure 7:
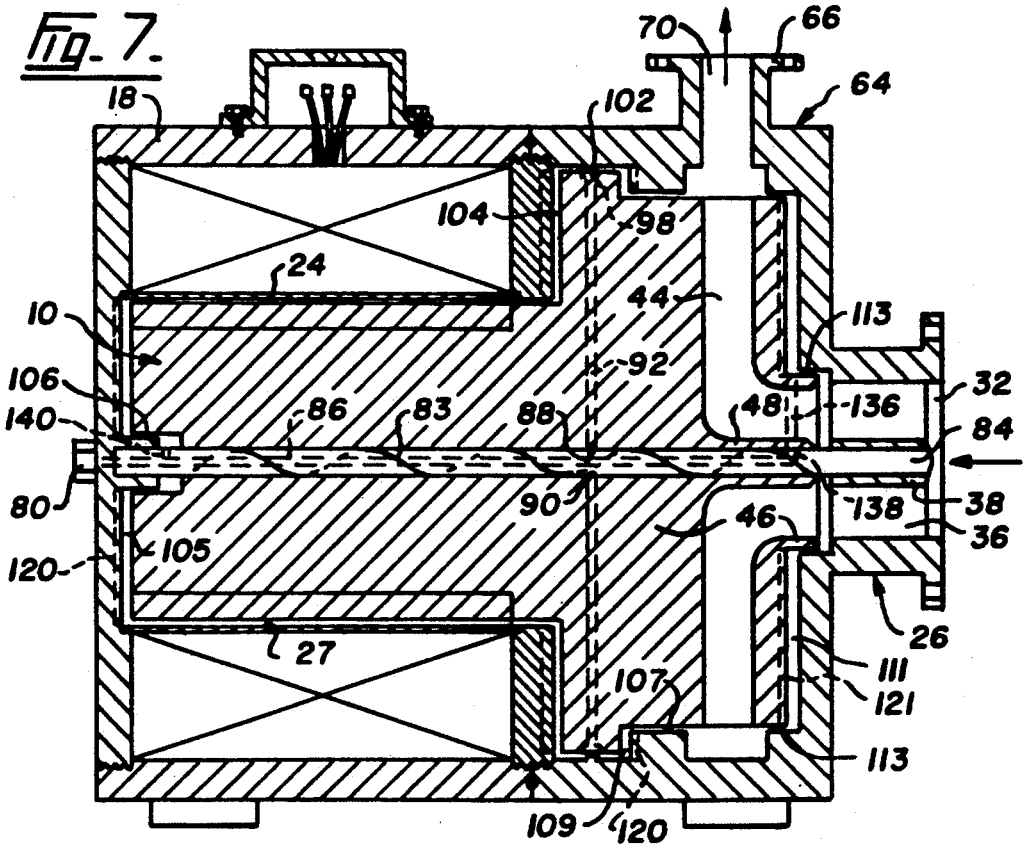
FIG. 7 is a longitudinal sectional view showing an embodiment similar to that shown in FIG. 6, but with the axial liquid entry at the impeller end of the unit.

FIG. 7 illustrates another embodiment of the integral motor and pump which employs the seal liquid pressurization system, hydrostatic radial bearing system, and hydrostatic thrust bearing principle of this invention. In this embodiment the inlet passageway 32 is located at the impeller end of the integral rotor and impeller assembly 10. Seal liquid in cavity 111 is supplied by radial duct 136 passing through the integral rotor and impeller outer body 46, impeller vane 44, and hub 48 to radial duct 138 connecting to seal liquid duct 86. The seal liquid discharging from seal 106 passes through radial duct 140 in shaft 84 and joins with the incoming seal liquid in duct 86.

Various flow and pressure characteristics of the integral motor pump are provided by selection of pump impeller type, diameter, impeller pitch, number of stages and the stage speeds.

The integral motor and pump embodiments disclosed herewithin may also serve as integral turbine generators under suitable application conditions. The seal liquid centrifugal pressurization, hydrostatic radial bearing and hydrostatic thrust bearing system disclosed herewithin may also be applied to an integral turbine generator unit as it applies to an integral motor and pump unit without departing from the scope of the present invention.

Various changes may be made to the embodiments shown herein without departing from the scope of the present invention which is limited only by the following claims.

The embodiments of the present invention in which an exclusive property or privilege is claimed are defined as follows:

1. An integral motor and pump comprising:

a stator having windings therein, integral with a pump casing, the pump casing having an axial liquid entry;

a rotor mounted for rotation on a fixed axial shaft within the stator, the rotor integral with impeller means for pumping liquid;

passage means through the fixed axial shaft for supplying seal liquid;

at least one liquid duct in the rotor, extending radially from the fixed axial shaft to pressurize seal liquid centrifugally when the rotor rotates within the stator, and hydrostatic thrust bearings supplied with the pressurized seal liquid to axially position the rotor relative to the stator.

2. The integral motor and pump according to claim 1 wherein the passage means for supplying seal liquid includes an external source of seal liquid and aperture means through the fixed axial shaft to connect with the liquid duct in the rotor.

3. The integral motor and pump according to claim 1, wherein the liquid duct extends to port openings on a peripheral surface of the rotor, and wherein a first port opening has a first flow restrictor associated therewith such that increased axial thrust on one end of the rotor increases the seal liquid supply to a first thrust bearing to counter the axial thrust, and a second port opening has a second flow restrictor associated therewith such that increased axial thrust on the other end of the rotor increases the seal liquid supply to a second thrust bearing to counter the axial thrust and consequently stabilize the axial position of the rotor relative to the stator.

4. The integral motor and pump according to claim 1 including hydrostatic radial bearings between the fixed axial shaft and the rotor.

5. The integral motor and pump according to claim 4 wherein seal liquid is supplied through an aperture means in the fixed axial shaft, and extends to a space between the shaft and the rotor to provide the hydrostatic radial bearings between the axial shaft and the rotor.

6. The integral motor and pump according to claim 3 wherein seal liquid from the hydrostatic thrust bearings is at a higher pressure than pumped liquid within the pump.

7. The integral motor and pump according to claim 1 wherein the stator and the rotor form an induction type motor.

8. The integral motor and pump according to claim 1 wherein the stator and the rotor form a permanent magnet type motor.

9. The integral motor and pump according to claim 1 wherein the casing has an axial liquid entry and an axial liquid outlet, and the rotor has a liquid passageway coaxial with the fixed axial shaft.

10. The integral motor and pump according to claim 9 wherein the axial liquid entry comprises stationary input diffuser and the axial liquid outlet comprises a stationary output diffuser, and means for supporting the fixed axial shaft.

11. The integral motor and pump according to claim 1 wherein the impeller is a radial flow impeller, and has a liquid side outlet.

12. A multiple stage integral motor and pump comprising:

a first stage stator integral with a pump casing having an axial liquid entry, a first stage rotor mounted for rotation within the first stage stator on a first fixed axial shaft, the first stage rotor adapted to rotate in a first rotational direction, and having a first axial liquid passageway with impeller means therein;

a second stage stator, integral with the pump casing and in line with the first stage stator;

a second stage rotor in line with the first stage rotor, mounted for rotation within the second stage stator on a second fixed axial shaft, the second stage rotor adapted to rotate counter to the first rotational direction, the second stage rotor having a second axial liquid passageway with impeller means therein;

an intermediate diffuser means fixed within the pump casing, in line between the first stage rotor and the second stage rotor, having an inter-stage axial liquid passageway therethrough;

passage means through at least one fixed axial shaft for supplying seal liquid;

at least one liquid duct in at least one rotor, extending radially from the at least one fixed axial shaft to pressurize seal liquid centrifugally when the rotor rotates within the stator, and hydrostatic thrust bearings supplied with the pressurized seal liquid to axially position the first stage rotor relative to the first stage stator, and the second stage rotor relative to the second stage stator.

13. The integral motor and pump according to claim 12 wherein more than two stages are provided with all stages axially in line and having axial liquid passageways therethrough.

14. The integral motor and pump according to claim 12 wherein the at least one liquid duct extends to port openings on a peripheral surface of the at least one rotor, and wherein a first port opening has a first flow restrictor associated therewith such that increased axial thrust on one end of the at least one rotor increases the seal liquid supply to a first thrust bearing to counter the axial thrust, and a second port opening has a second flow restrictor associated therewith such that increased axial thrust on the other end of the at least one rotor increases the seal liquid supply to a second thrust bearing to counter the axial thrust and consequently stabilize the axial position of the at least one rotor relative to the stator.

15. The integral motor and pump according to claim 12 wherein the first stage rotor and the second stage rotor rotate at different rotational speeds.

16. The integral motor and pump according to claim 12 wherein at least two stages are provided with the stages being in module form.

17. An integral generator and turbine comprising:

a stator having windings therein, integral with a turbine casing, the turbine casing having an axial liquid entry;

a rotor mounted for rotation on a fixed axial shaft within the stator, the rotor integral with impeller means for rotation with liquid flow;

passage means through the fixed axial shaft for supplying seal liquid;

at least one liquid duct in the rotor, extending radially from the fixed axial shaft to pressurize seal liquid centrifugally when the rotor rotates within the stator; and hydrostatic thrust bearings supplied with the pressurized seal liquid axially position the rotor relative to the stator.

* * * * *